United States Patent [19]

Mendelson

[11] 4,340,008

[45] Jul. 20, 1982

[54] TILT INDICATOR FOR SHIPPING CONTAINERS

[76] Inventor: Ralph R. Mendelson, 3137 Fairmount Blvd., Cleveland Heights, Ohio 44118

[21] Appl. No.: 189,797

[22] Filed: Sep. 22, 1980

[51] Int. Cl.[3] ..... G08B 5/00

[52] U.S. Cl. ..... 116/215; 206/305

[58] Field of Search ..... 116/215, 219, 206; 73/431; 206/305

[56] References Cited

U.S. PATENT DOCUMENTS

| | | | |
|---|---|---|---|
| 2,674,221 | 4/1954 | Tinsley | 116/114 |
| 2,768,602 | 10/1956 | Eichholz et al. | 116/114 |
| 3,177,843 | 4/1965 | Geocaris | 116/114.5 |
| 3,207,122 | 9/1965 | Salembier | 116/114 |
| 3,362,834 | 1/1968 | Kaye | 99/192 |
| 3,467,053 | 9/1969 | Davis et al. | 116/114 |
| 3,545,400 | 12/1970 | Smith | 116/114.5 |
| 3,620,677 | 11/1971 | Morison | 23/253 |
| 3,688,734 | 9/1972 | Davis et al. | 116/114 A H |
| 3,926,144 | 12/1975 | Lander | 116/124 R |
| 4,071,065 | 1/1978 | Halbich | 206/305 |
| 4,229,813 | 10/1980 | Lilly | 116/206 |

*Primary Examiner*—Stuart S. Levy
*Assistant Examiner*—Denis E. Corr
*Attorney, Agent, or Firm*—Meyer, Tilberry & Body

[57] ABSTRACT

An indicator attachable to a shipping container is adapted to visually indicate whether or not the container has been excessively tilted during transportation thereof. The indicator includes a thin sheet of absorbent paper carrying a small receptacle containing a colored ink or holding a glass ampoule containing ink. The receptacle has an upper end from which the ink flows from the receptacle onto the absorbent paper when the container is excessively tilted. The absorbent paper and receptacle are removably enclosed in an envelope of thin transparent plastic adapted to be taped onto an upright container wall. Upon tilting of the container and displacement of the colored ink onto the absorbent paper, the latter is stained thereby and the color change is visible through the envelope. Preferably, the indicator is taped to the inside surface of a container wall which is provided with an opening through which the indicator is visible from outside the container.

19 Claims, 9 Drawing Figures

TILT INDICATOR FOR SHIPPING CONTAINERS

BACKGROUND OF THE INVENTION

The present invention relates to the art of indicating devices and, more particularly, to an indicator for visually indicating that a shipping container has been excessively tilted during transportation thereof from one location to another.

It is known to provide shipping containers with indicating devices which are operable to provide a person receiving goods shipped in the containers with a visual indication as to whether or not the latter may be damaged as a result of excessive tilting during transportation thereof. In this respect, certain goods need to be maintained in an upright or substantially upright position during transportation, in that excessive tilting of the container in which the goods are shipped can result in undue strain on component parts of the goods and damage or breakage thereof. Such indicating devices generally include a flowable colored granular or liquid material in combination, respectively, with a tacky or stainable material onto which the granular or liquid material flows upon excessive tilting of the container, thus to provide a visual indication of such tilting and a warning to the receiver that the goods may be damaged. While such indicating devices heretofore provided are capable of serving their intended purpose, they are structurally complex and thus expensive to manufacture, whereby the cost thereof to the consumer has limited their acceptance and use. In this respect, for example, the indicating devices require special container designs and constructions for the flowable material which necessitates sophisticated and expensive tooling. Further, assembly procedures with respect to the component parts of the indicators are time consuming and may require specialized machines and equipment which further adds to the cost of the final product.

SUMMARY OF THE INVENTION

In accordance with the present invention, an improved shipping container tilt indicator is provided which is structurally simple and considerably less expensive to produce than such indicators heretofore provided. In this respect, a tilt indicator according to the present invention is comprised of a sheet of stainable material having opposite sides and a peripheral edge, and a receptacle mounted on one of the sides of the sheet and inwardly of the peripheral edge thereof. The receptacle either contains a flowable material capable of staining the sheet, or supports a rupturable container of such material, and the sheet and receptacle are received in a transparent sheet material enclosure through which the sheet is visible. The receptacle has an upper end in connection with the orientation of the indicator when mounted on a shipping container and, in use, the upper end of the receptacle provides an outlet through which the flowable material can flow onto the sheet of stainable material. To mount the indicator on a carton wall, the sheet and receptacle are confined within the enclosure, and the latter is attached to the wall such as by the use of an adhesive tape. Should the shipping container be excessively tilted during transportation thereof, the material flows from the receptacle onto the stainable sheet, thus providing a visual indication that the goods in the shipping container may be damaged. The enclosure, in addition to supporting the sheet material and receptacle, serves to retain the flowable material within the confines of the indicating device upon flow of the material from the receptacle.

The stainable sheet material and the flowable material can be any combination of materials which will provide a visible color indication upon flow of the material onto the sheet. The receptacle for the flowable material can be of plastic, metal, metal foil or other suitable material having sufficient rigidity to retain its shape, or sufficient resiliency to return to its initial shape and, preferably, is adhesively bonded to the sheet of stainable material. The transparent enclosure can be a thin flexible plastic film of sufficient area to enable wrapping thereof around the sheet and receptacle and, preferably, is an envelope closed on three sides and providing for convenient storage of the sheet material and receptacle prior to use of the indicator. It will be appreciated, therefore, that a tilt indicator in accordance with the present invention is comprised of component parts which are structurally simple and readily and economically available or obtainable, and which component parts are structurally interrelated in a manner which minimizes production time and cost.

It is accordingly an outstanding object of the present invention to provide an improved tilt indicator mountable on an upright wall of a shipping container.

Another object is the provision of an indicator of the foregoing character which is structurally simple, economical to produce, easy to mount on a shipping container and efficient in use.

Yet another object is the provision of an indicator of the foregoing character which is comprised of a minimum number of component parts which are structurally simple and interrelated in a manner which minimizes production time and cost while facilitating preparation for use and attachment to a shipping container.

A further object is the provision of an indicator of the foregoing character which is comprised of a sheet of stainable material carrying a small receptacle holding a flowable material which, upon flow onto the stainable sheet, is cooperable therewith to provide a color indication different from that of the initial color of the sheet, and a transparent enclosure removably receiving the sheet and receptacle and through which the color indication is visible.

BRIEF DESCRIPTION OF THE DRAWING

The foregoing objects, and others, will in part be obvious and in part pointed out more fully hereinafter in connection with the written description of a preferred embodiment of the invention illustrated in the drawings in which.

DESCRIPTION OF THE PREFERRED EMBODIMENT

Figure 1:
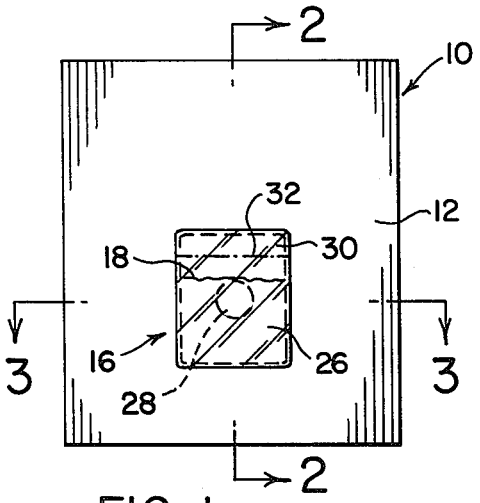
FIG. 1 is a front elevation view of the stainable sheet material and receptacle components of an indicator made in accordance with the present invention.
Figure 2:
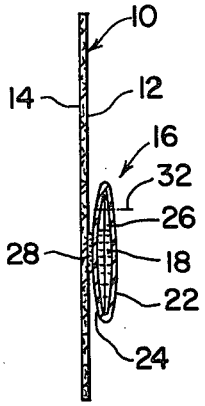
FIG. 2 is a sectional elevation view taken along line 2—2 in FIG. 1.
Figure 3:
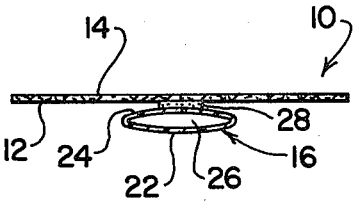
FIG. 3 is a cross-section view taken along line 3—3 in FIG. 1.

Referring now in greater detail to the drawing, wherein the showings are for the purpose of illustrating preferred embodiments of the invention only and not for the purpose of limiting the invention, FIGS. 1–7 illustrate a tilt indicator according to the present invention which includes a thin sheet of stainable material 10 having opposite sides 12 and 14, a receptacle 16 mounted on side 12 of sheet 10 inwardly of the peripheral edge thereof and containing a flowable material 18, and an enclosure 20 of transparent plastic sheet material to removably receive sheet 10 and receptacle 16, as set forth more fully hereinafter. In the preferred embodiments, sheet 10 is an absorbent paper which is initially of light color such as white, and flowable material 18 is a colored liquid such as black ink. However, it will be appreciated that sheet 10 can be of any material which is treated to be or is inherently capable of being stained by flowable material 18 which, in turn, is of a nature whereby it is capable of staining sheet 10.

In the embodiment shown in FIGS. 1–7, receptacle 16 is comprised of a suitable plastic material such as polyethylene and has outer and inner sides 22 and 24 with respect to side 12 of sheet 10. Sides 22 and 24 are sealed about the peripheral edges thereof to provide for the receptacle to be initially closed, and the receptacle has a tear drop configuration in cross-section providing a chamber 26 for material 18. Receptacle 16 is mounted on sheet 10 such as by a suitable adhesive 28 therebetween, and the receptacle has an upper end 30 in the orientation illustrated in FIGS. 1 and 2 which is adapted to be opened by severing the receptacle along a line above the level of material 18, such as indicated by broken line 32 in FIG. 1. It will be appreciated that severing of the upper end of the receptacle can be achieved with sissors, a razor blade, or the like, and that such severing provides an outlet opening through which material 18 can flow onto sheet 10 in response to tilting of the latter from the vertical orientation. Receptacle 16 is mounted on sheet 10 for the upper end of the receptacle, when open, to be horizontally and vertically centered with respect to the peripheral edge of the sheet. Plastic receptacle 16 can be constructed in any suitable manner, such as by blow molding, and material 18 can be introduced into chamber 26 in any suitable manner such as by injection through a wall of the receptacle.

While receptacle 16 in this embodiment is preferably plastic and constructed as described above, it will be appreciated that the receptacle can be constructed from any material capable of holding the flowable material 18, whereby the selection of the material of the receptacle will be dependent in part on the nature of the flowable material. If flowable material 18 is a granular substance, receptacle 16 can, for example, be constructed from paper, metal, metal foil, or plastic, and if material 18 is a liquid the receptacle can be constructed from any suitable material impervious to such liquid, such as a treated paper, plastic, metal or metal foil, for example. Receptacle 16 can have any desired structural configuration, it only being important that the receptacle has sufficient rigidity or structural integrity to hold its shape. While the upper end of receptacle 16 is described above as being openable by severing, the receptacle could be manufactured with an open upper end which would be closed prior to use by a removable cover or plug.

Figure 4:
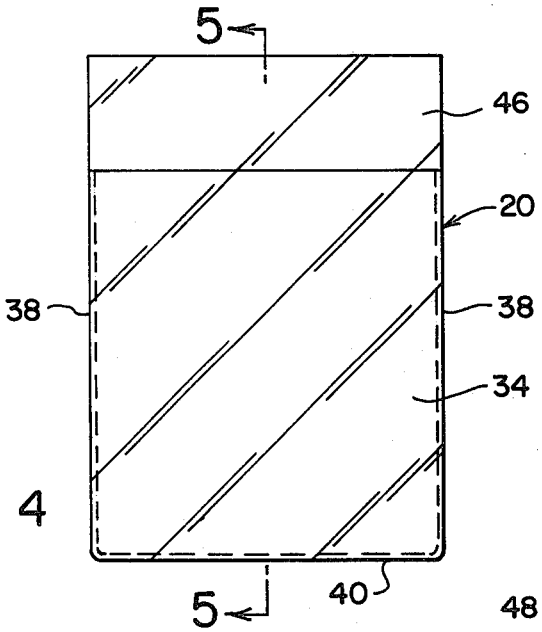
FIG. 4 is a front elevation view of the enclosure component for the indicator.
Figure 5:
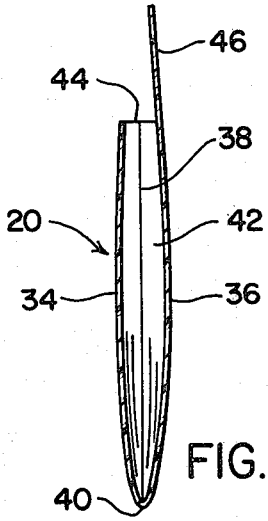
FIG. 5 is a sectional elevation view taken along line 5—5 in FIG. 4.

As best seen in FIGS. 4 and 5 of the drawing, enclosure 20 is preferably in the form of an envelope of thin transparent plastic material such as polyethylene having opposite side walls 34 and 36 integrally or otherwise sealed together to provide opposite side edges 38 and a bottom edge 40. Edges 38 and 40 together with walls 34 and 36 define a pocket 42 adapted to removably receive sheet 10 and receptacle 16 through opening 44 at the upper ends of side edges 38. Preferably, wall 36 includes an extension 46 providing a flap adapted to be folded downwardly to overlie the upper end of wall 34, thus to close opening 44. The plastic material of enclosure 20 is extremely thin and flexible and, for example, of a thickness of from about 0.5 mil to 2.0 mils, although plastic film of greater thickness can be employed. While enclosure 20 is preferably in the form of an envelope closed on three sides, it will be appreciated that a suitable enclosure for sheet 10 and receptacle 16 can be provided by a thin sheet of transparent plastic material of sufficient dimension to wrap around sheet 10 and receptacle 16.

Figure 7:
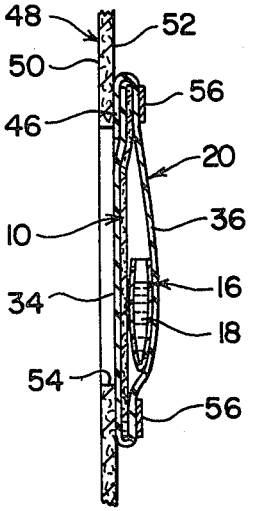
FIG. 7 is a sectional elevation view taken along line 7—7 in FIG. 6.
Figure 6:
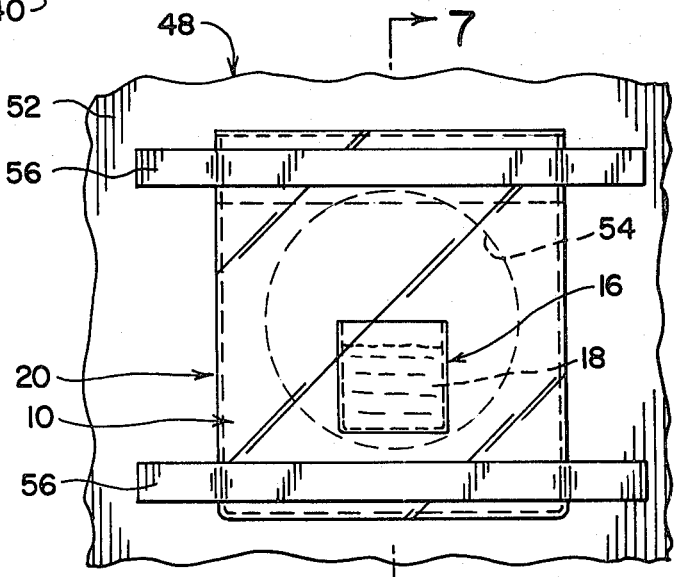
FIG. 6 is an elevation view showing the component parts in assembled relationship and mounted on an upright wall of a shipping container.

Prior to use of the indicating device, enclosure 20 provides for the convenient storage of sheet 10 and receptacle 16. When the indicator is to be used, sheet 10 is removed from the enclosure and receptacle 16 is severed along line 32 to open the upper end thereof, after which the sheet is replaced in pocket 42 and the indicator is mounted on an upright container wall, as illustrated in FIGS. 6 and 7 of the drawing. In this respect, numeral 48 in FIGS. 6 and 7 represents an upright container wall having outer and inner sides 50 and 52, respectively. The indicator can be mounted on either side of the container wall and, preferably, is mounted on the inner side thereof to span an opening 54 through the container wall, whereby the indicator is protected from contact with other shipping containers or the like and cannot be tampered with by the transporter. After receptacle 16 has been severed along line 32 as described above and sheet 10 has been replaced in pocket 42 of the enclosure, flap 46 is folded downwardly over the outer surface of wall 34 to close opening 44, and the indicator is suitably attached to container wall 48, preferably by strips of adhesive tape 56 which extend across the envelope and onto the container walls. The open upper end of receptacle 16 faces upwardly, and the level of flowable material 18 below the open upper end of receptacle 16 is such as to provide for material 18 to flow through the open upper end and onto sheet 10 if the shipping container is thereafter tilted beyond a predetermined degree. With the paper and ink combination described above, such excessive tilting would result in the flow of black ink from receptacle 16 onto absorbent paper sheet 10 thus changing the color thereof from white to black, and the change in color would be visible through opening 54 in the container wall and wall 34 of enclosure 20.

While it is preferred to provide the envelope with a flap for closing the opening thereinto, it will be appreciated that such a flap is not necessary. In this respect, the opposite sides of the envelope could have corresponding upper edges defining the opening, and the opening could be closed by folding an upper portion of the walls to lie across one of the envelope walls in a manner similar to that of the flap. Alternatively, the opening in such a modification could be closed by positioning the mounting tape 56 to vertically span the upper edges of the envelope. Furthermore, while sheet 10 is preferably square and the pocket in the envelope is of corresponding contour and dimensions, these characteristics are preferred from the standpoint of manufacture, and other contours can be employed. Still further, it will be appreciated that the indicating device can be mounted on a container wall by a suitable adhesive between the envelope and container wall, or through the use of staples, or other fastening arrangements, the use of an adhesive tape being preferred again from the standpoint of cost and ease of mounting.

Figure 8:
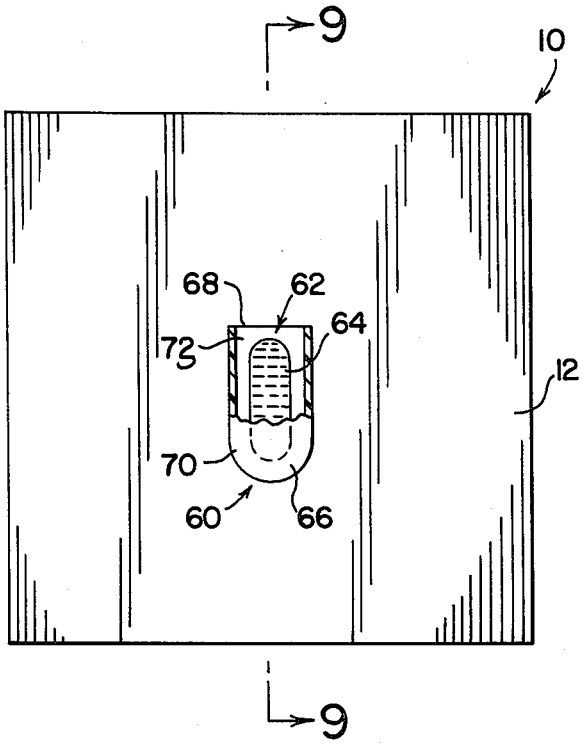
FIG. 8 is a front elevation view showing a modification with respect to the receptacle and flowable material; and, FIG. 9 is a cross-sectional elevation view taken along line 9—9 in FIG. 8.
Figure 9:
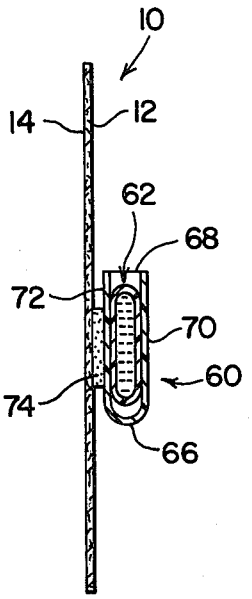

FIGS. 8 and 9 of the drawing illustrate a modification with respect to the receptacle and flowable material portion of an indicating device according to the present invention. In this respect, the receptacle and flowable material portion is defined by a first receptacle 60 and a second receptacle 62 received in receptacle 60 and containing flowable material 64. As in the embodiment illustrated in FIGS. 1–7, receptacle 60 is illustrated as being mounted on side 12 of stainable sheet material 10 and, for purposes of example, sheet 10 is an absorbent white paper and flowable material 64 is a colored ink. Receptacle 60 is produced from a suitable resilient material, such as polyethylene, and is of a generally tubular configuration having a closed bottom 66, an open top 68 and outer and inner sides 70 and 72 with respect to side 12 of sheet 10. The receptacle is mounted on sheet 10 such as by an adhesive 74 so that open upper end 68 is horizontally and vertically centered with respect to the peripheral edge of the sheet. The contour of receptacle 60 provides an open top pocket adapted to receive receptacle 62, and the construction of receptacle 60 and the resiliency of the material from which it is constructed provides for receptacle 60 to be squeezed so as to constrict the pocket, for the purpose set forth hereinafter, and to thereafter return to its initial configuration.

Receptacle 62 is an initially closed receptacle of frangible material containing flowable material 64 and which is adapted to be fractured or broken upon squeezing receptacle 60 in the manner referred to hereinabove. When so fractured, flowable material 64 enters receptacle 60 and can then flow through upper end 68 thereof onto sheet material 10 upon tilting of the indicator when mounted on a carton wall. A thin walled glass ampoule of the type commonly used for medicinal purposes provides a very satisfactory and inexpensive frangible receptacle for use in connection with the present invention.

In use of the foregoing modification in accordance with the present invention, it will be appreciated that sheet 10 and receptacles 60 and 62 are received in a transparent enclosure of thin plastic film material as described hereinabove in connection with the embodiment illustrated in FIGS. 1–7, and that the indicating device is mounted on a container wall in the manner also described hereinabove. In connection with such mounting of the indicator, the frangible receptacle feature advantageously enables the preparation of the indicating device by fracturing the receptacle to be achieved without removing the sheet and receptacle assembly from the enclosure.

It will be appreciated from the embodiments illustrated in FIGS. 1–9 of the drawing that the receptacles are relatively small horizontally and vertically in comparison with the dimensions of the peripheral edges of the stainable sheet material. It will be further appreciated that the stainable sheet and receptacle arrangements provide for unconfined flow of the material onto the sheet upon tilting of the container on which the indicator device is mounted, whereby the entire sheet is exposed to staining. The receptacle need only be large enough to hold a sufficient amount of flowable material for the latter purpose. Accordingly, the receptacle can be substantially smaller than the peripheral dimensions of the sheet, promoting economy with respect to cost of the indicating device. Moreover, the unconfined flow advantageously enables varying degrees of staining of the sheet material depending on the extent of tilting of the container on which the indicator is mounted and, thus, advantageously provides an indication of the extent of tilting and the degree of excessiveness thereof.

The terms stainable sheet material and flowable material as used herein are intended to be inclusive of any sheet material or sheet material surface having a given initial color which is changed or masked upon flow of the material from the receptacle onto the sheet. Such a stainable sheet and flowable material combination can include, for example, a sheet of wood, paper, plastic, cloth, or foil coated with a tacky substance, and a granular material of a color different from that of the sheet or tacky substance and which will stick to the tacky surface upon flow thereonto thus masking the initial color. As another example, the stainable sheet can be a wood, paper, cloth or plastic sheet, and the flowable material can be a liquid material of a color different from that of the sheet and which would be absorbed by the wood, paper or cloth and would stain the surface of the plastic sheet. As yet another example, the stainable sheet can be a paper, cloth, or other sheet which would chemically react with a liquid material to produce a color change in the sheet material, such as by bleaching the latter.

As many embodiments of the present invention can be made and as many changes can be made in the embodiments herein illustrated and described, including those modifications referred to specifically hereinabove, it is to be distinctly understood that the foregoing descriptive matter is to be interpreted merely as illustrative of the present invention and not as a limitation.

Having thus described the invention, it is claimed:

1. A tilt indicator mountable on an upright wall of a shipping container comprising, a sheet of stainable material having opposite sides and peripheral edge means, receptacle means on one of said sides of said sheet and spaced inwardly from said edge means, said receptacle means being separate from said sheet and having an upper end and inner and outer receptacle walls with respect to said one side of said sheet, means fastening said inner receptacle wall to said one side of said sheet for said receptacle means to be mounted on said sheet outwardly adjacent said one side, a flowable material in said receptacle means capable of staining said sheet, said receptacle means including means to provide an outlet at said upper end through which said flowable material can flow onto said sheet upon tilting said shipping container, and enclosure means of a transparent plastic film of material removably receiving and completely surrounding and enclosing said sheet and receptacle means, said enclosure means confining said flowable material therein and being mountable on said upright container wall to support said sheet and receptacle means thereon.

2. An indicator according to claim 1, wherein said sheet is a liquid absorbing material and said flowable material is a colored liquid.

3. An indicator according to claim 1, wherein said receptacle means is initially closed and comprised of a material severable to provide said outlet.

4. An indicator according to claim 3, wherein said receptacle material is plastic.

5. An indicator according to claim 1, wherein said enclosure means includes envelope means having a pocket and an opening thereinto for said pocket to removably receive said sheet and receptacle means.

6. An indicator according to claim 5, wherein said envelope means includes flap means for closing said opening.

7. An indicator according to claim 1, wherein said sheet is a liquid absorbing material, said flowable material is a colored liquid, and said receptacle means is initially closed and comprised of a material severable to provide said outlet.

8. An indicator according to claim 7, wherein said receptacle material is plastic.

9. An indicator according to claim 8, wherein said enclosure means includes envelope means having a pocket and an opening thereinto for said pocket to removably receive said sheet and receptacle means.

10. An indicator according to claim 9, wherein said envelope means includes flap means for closing said opening.

11. An indicator according to claim 1, wherein said receptacle means includes first and second receptacles, said first receptacle having said upper end and said inner and outer receptacle walls and being mounted on said sheet, said upper end of said first receptacle being open to provide said outlet, said receptacle walls providing a receptacle pocket removably receiving said second receptacle through said outlet, and said second receptacle being a closed receptacle of frangible material containing said flowable material.

12. An indicator according to claim 11, wherein said enclosure means includes envelope means having an envelope pocket and an opening thereinto for said envelope pocket to removably receive said sheet and receptacle means.

13. An indicator according to claim 12, wherein said envelope means includes flap means for closing said opening into said envelope pocket.

14. An indicator according to claim 11, wherein said first receptacle is comprised of resilient plastic material and said second receptacle is a glass ampoule.

15. An indicator according to claim 14, wherein said sheet is a liquid absorbing material and said flowable material is a colored liquid.

16. An indicator according to claim 14, wherein said enclosure means includes envelope means having an envelope pocket and an opening thereinto for said envelope pocket to removably receive said sheet and receptacle means.

17. An indicator according to claim 16, wherein said envelope means includes flap means for closing said opening into said envelope pocket.

18. An indicator according to claim 16, wherein said sheet is a liquid absorbing material and said flowable material is a colored liquid.

19. An indicator according to claim 18, wherein said envelope means includes flap means for closing said opening into said envelope pocket.

* * * * *